US006972755B2

(12) United States Patent
Plangger

(10) Patent No.: US 6,972,755 B2
(45) Date of Patent: Dec. 6, 2005

(54) DRIVER CIRCUIT FOR A DISPLAY DEVICE

(75) Inventor: Guido Plangger, Eschenbach (CH)

(73) Assignee: Koninklijke Philips Electronics N.V., Eindhoven (NL)

( * ) Notice: Subject to any disclaimer, the term of this patent is extended or adjusted under 35 U.S.C. 154(b) by 521 days.

(21) Appl. No.: 10/042,444

(22) Filed: Jan. 8, 2002

(65) Prior Publication Data

US 2002/0093992 A1 Jul. 18, 2002

(30) Foreign Application Priority Data

Jan. 9, 2001 (DE) ..... 101 00 569

(51) Int. Cl.[7] ..... G09G 5/00

(52) U.S. Cl. ..... 345/204; 345/904; 324/403; 324/770

(58) Field of Search ..... 345/204, 904; 348/180; 324/403, 770

(56) References Cited

U.S. PATENT DOCUMENTS 4,028,536 A * 6/1977 Woodward ..... 714/820
4,194,113 A * 3/1980 Fulks et al. ..... 714/732
4,453,128 A * 6/1984 Steinmetz ..... 324/403
5,877,736 A * 3/1999 Imajo et al. ..... 345/89
5,994,916 A * 11/1999 Hayashi ..... 324/770

* cited by examiner

*Primary Examiner*—Ricardo Osorio
(74) *Attorney, Agent, or Firm*—Kevin Simons

(57) ABSTRACT

The invention relates to a device for driving display devices and to a display device that is provided with a driver circuit. The invention also relates to a method of testing driver circuits. Driver circuits of this kind have a decisive effect on the quality of the display devices. Therefore, in order to ensure a good quality, the driver circuit must be extensively tested, that is, with an as short as possible test time and using as few means as possible. In order to make such a test possible, a device for driving the display devices is provided with M leads that are coupled to $A_N$ output stages that are provided with at least one multiplex device (4) and at least one amplifier unit (5), the M leads being coupled to a first switching device (2) that enables the interruption of a voltage supply to the M leads, and at least one second switching device (3) being provided in at least one output stage ($A_N$) in order to switch the output stage ($A_N$) to a selectable potential. This enables the use of a test that can be carried out digitally.

9 Claims, 3 Drawing Sheets

DRIVER CIRCUIT FOR A DISPLAY DEVICE

BACKGROUND OF THE INVENTION

The invention relates to a device for driving display devices, and to a display device that includes a driver circuit. The invention also relates to a method of testing driver circuits.

In coming years the display technique will play a more and more important part in the field of information and communication. Being the interface between humans and the digital world, the display device is of crucial importance for the acceptance of modem information systems. Notably portable apparatus such as, for example notebooks, telephones, digital cameras and personal digital assistants (PDA) cannot be realized without using flat displays.

Active matrix displays are of particular importance, because such a display device enables fast image changes, for example, in the display of the cursor of a mouse. According to this active matrix LCD technique the image points or pixels are actively driven. The version that is most frequently used utilizes thin film transistors (TFT-LCD). Transistors that are made of silicon and are integrated directly in each pixel therein enable the storage of the image signals in the pixel. In order to realize different grey values or colors in the display of information, it is necessary to drive the displays or display devices with respective different voltages in a large voltage range. Driver circuits are used for such driving of the display device or display.

Active matrix displays (TFT displays) typically consist of a glass with connections that are fed out and whereto the driver circuits are connected. Such driver circuits convert the image signals to be displayed on a display. The image information is stored in the form of digital signals in memories. Such digital signals must be converted into analog signals, so that a corresponding light intensity can be displayed by way of an analog voltage. The digital-to-analog converters that are necessary for this conversion must convert digital signals into voltages that range from a value of less than 20 mV to more than 10 V.

Display units are marketed as modules that are composed of the active matrix TFT displays and the driver circuit. The quality of the driver ICs is very important in this respect. Because such driver circuits have to drive several hundred terminals of the display device, the testing of such a driver circuit is very intricate. The test operation for these driver circuits has a decisive effect on the quality of the display device and hence also on the price of the finished products. Therefore, the test time should be as short as possible. The use of intricate precision measuring apparatus for the test operation also has a negative effect on the price of the finished products. High yields of display modules, and hence low costs of the finished products, can be achieved only in the case of a very high quality of every individual driver circuit.

Because driver circuits consist essentially of a large number of digital-to-analog converters, the quality of such apparatus can be guaranteed only when the digital-to-analog converters are seriously tested. Because of the digital-to-analog conversion of the digital image signals, the standard test methods for digital logic cannot be used for this driver circuit. Because it is necessary to generate and test very many different voltage values in a wide range, a test for the driver circuits is very intricate.

A driver circuit typically is supplied with a plurality of analog voltages wherefrom selection units select voltages in dependence on the digital image signals, which selected voltages are subsequently applied to a corresponding output of the driver circuit so as to be amplified. For example, a driver circuit is provided with 64 leads that carry analog voltages and with 400 output stages, so that at least 25,600 separate analog voltage values must be tested.

The testing of every individual analog voltage value is very time consuming, because each individual value must be programmed and directly tested. Every selectable analog voltage must be tested at each output of the driver circuit. A large number of outputs of such a driver circuit necessitates the simultaneous parallel measurement of as many as 400 and possibly even more analog outputs. The measurement of a large number of analog outputs with an accuracy of 0.2% of the overall voltage range necessitates the use of very expensive test equipment. Such a functional test leads to very high test costs and becomes manifest as a very long test time. The functional tests as described above may also involve faults that arise in the manufacture of the wafers and cannot be detected or not reliably detected. Critical defects such as, for example, leakage currents between the leads that carry the analog voltages and the output leads can be detected only when the one digital-to-analog converter for the M lead carries a voltage that deviates very significantly from the voltage on the output lead. As is known, so-called functional tests are not as conclusive as test methods and test devices in which defect-oriented testing takes place.

BRIEF SUMMARY OF THE INVENTION

Therefore, it is an object of the invention to provide a driver circuit that can be tested within the shortest possible period of time and with a very extensive fault coverage.

This object is achieved in that a device for driving display devices is provided with M leads that are coupled to at least one multiplex device and to a first switching device that enables interruption of a voltage supply to the M leads, and also provided with at least one second switching device that is coupled to the M leads and whereby at least one of the M leads can be switched to a selectable potential.

The basic idea of the device in accordance with the invention is to provide a defect-oriented test and a method that is suitable for that purpose. The use of additional test hardware that is added to the driving device or driver circuit eliminates the need for numerous individual analog measurements whereas the fault error coverage remains equally high or is even enhanced nevertheless.

To this end, a first switching device is inserted in the M leads. The first switching device interrupts the voltage supply, so that a voltage already present is no longer driven and is held until any leakage currents or parasitic capacitances give rise to a discharge. The analog voltages on the M leads can be selected via multiplex devices. The multiplex devices are driven by digital signals. These digital signals contain the image information to be displayed and influence the multiplex device, acting as an ideal switch, in such a manner that a selected voltage on the M leads is applied to an output N.

In accordance with the invention there is provided a second switching device whereby the voltage that is selected by the multiplex device can be switched to a selectable test reference potential. This selectable or definable test reference potential is preferably ground. The second switching device connects the voltage that is switched through by the multiplex device to a selectable test reference potential. The second switching device enables the M leads that are no longer driven after the opening of the first switching device to be switched through to the second switching device by control of the multiplex device, said second switching device then switching the lead M thus selected to a fixed potential. In the normal case this potential is adjusted on the selected lead and can be simply and readily monitored. If this fixed potential is not present on the selected lead, it is to be assumed that a faulty driver circuit is involved. This enables simple testing of the functionality of the driver circuit. Any leakage currents between different M leads can be simply detected because, when a special lead $M_I$ is selected and switched through to the second switching device, any leakage current present can be dissipated via the second lead, so that the necessary level would not be detected during the monitoring of the output N or the selected lead $M_I$ and the further lead connected thereto in a faulty manner.

In a preferred embodiment of the driver circuit in accordance with the invention the M leads are coupled to $A_N$ output stages. The output stages $A_N$ include not only the multiplex device but also an amplifier unit. This amplifier has a variable gain and is configured to be high-ohmic at the input side, so that the corresponding output can be driven with a corresponding value. The second switching device is preferably arranged in at least one output stage. It is thus achieved that the multiplex devices present are effectively used.

The switching device in a preferred embodiment of the invention is constructed in such a manner that separate interruption of the M leads is possible. A further degree of freedom is thus created for the test.

The driver circuit in accordance with the invention enables the detection of leakage currents between individual leads of the M leads. Incorrect selection of the multiplex devices can also be detected, for example when the lead M1 is to be selected even though the lead M2 was selected.

In the case of an excessively high forward resistance of a switch in the multiplex device, it can also be detected that the voltage of the lead M is not switched through or only after a delay. Furthermore, leakage currents between an M lead and an output N can be detected. A test then proves to be difficult in as far as the leakage current occurs only when the corresponding multiplex device has also selected the corresponding M lead. The test coverage can be increased by way of this additional test.

In accordance with the invention the M leads are driven with a voltage that represents, for example, a digital signal 1. The M leads are separated from the voltage supply by means of the first switching device so as to be set to a tristate condition.

As a result of the insertion of the second switching device in at least some of the output stages, all M leads can be successively switched to a test reference potential. After the opening of the first switching device, the M leads retain their voltage value for a given period of time until internal parasitic capacitances give rise to a discharge. Consequently, during this period the same voltage value as present on the lead M can be measured on the output N. Because of the subsequent closing of all second switching devices, at least some of the M leads can be switched to the test reference potential and to check the M leads as to which of the M leads are switched to zero. In case a leakage current exists between a lead that is switched to the test reference potential and a non-driven lead M, the non-driven lead M is also switched to the test reference potential.

In a preferred arrangement for the testing of such driver circuits, the M leads are all connected to one another in a test mode so as to be driven with a common, equal voltage. After the formation of a voltage on these leads, the first switching device is opened and all leads carry the same voltage. In the output stages that are not provided with a second switching device, the voltage adjusted on the M leads can be tested on the output N. On the outputs N of the output stages that are provided with the second switching devices and in which the second switching devices are closed, it can be tested whether the outputs are connected to the test reference potential or not. At the same time the other output stages that are not provided with second switching devices can be tested as to whether the outputs of these output stages are also connected to the test reference potential. Therefrom it can be deduced that a short circuit could exist between correspondingly selected leads M.

An advantage of the arrangement in accordance with the invention resides in the fact that the driver circuit for a display device can be tested practically completely digitally, so that the test time is significantly reduced. In comparison with analog measurements, at the same time far simpler test and measuring equipment are required for a digital test. Because of the digital test signal, many test states can be realized so that a very extensive fault coverage can be achieved. Because of the digital nature of the test method, the entire test arrangement is very robust against disturbances by electromagnetic radiation.

The object is also achieved by means of a display device that includes a driver circuit in which the N outputs of the driver circuit are connected to N terminals of the display device.

Furthermore, the object is also achieved by means of a method of testing driver circuits in which the driver circuit is supplied with at least one voltage on M leads, in which the M leads are coupled to a first switching device and the voltage supply to the M leads is interrupted by means of the first switching device, in which one of the M leads is selected by means of at least one multiplex device that is coupled to the M leads, and in which the voltage on the selected lead is switched to a test reference potential by means of a second switching device.

Embodiments in accordance with the invention will be described in detail hereinafter with reference to the drawings. Therein:

DETAILED DESCRIPTION OF THE INVENTION

Figure 1:
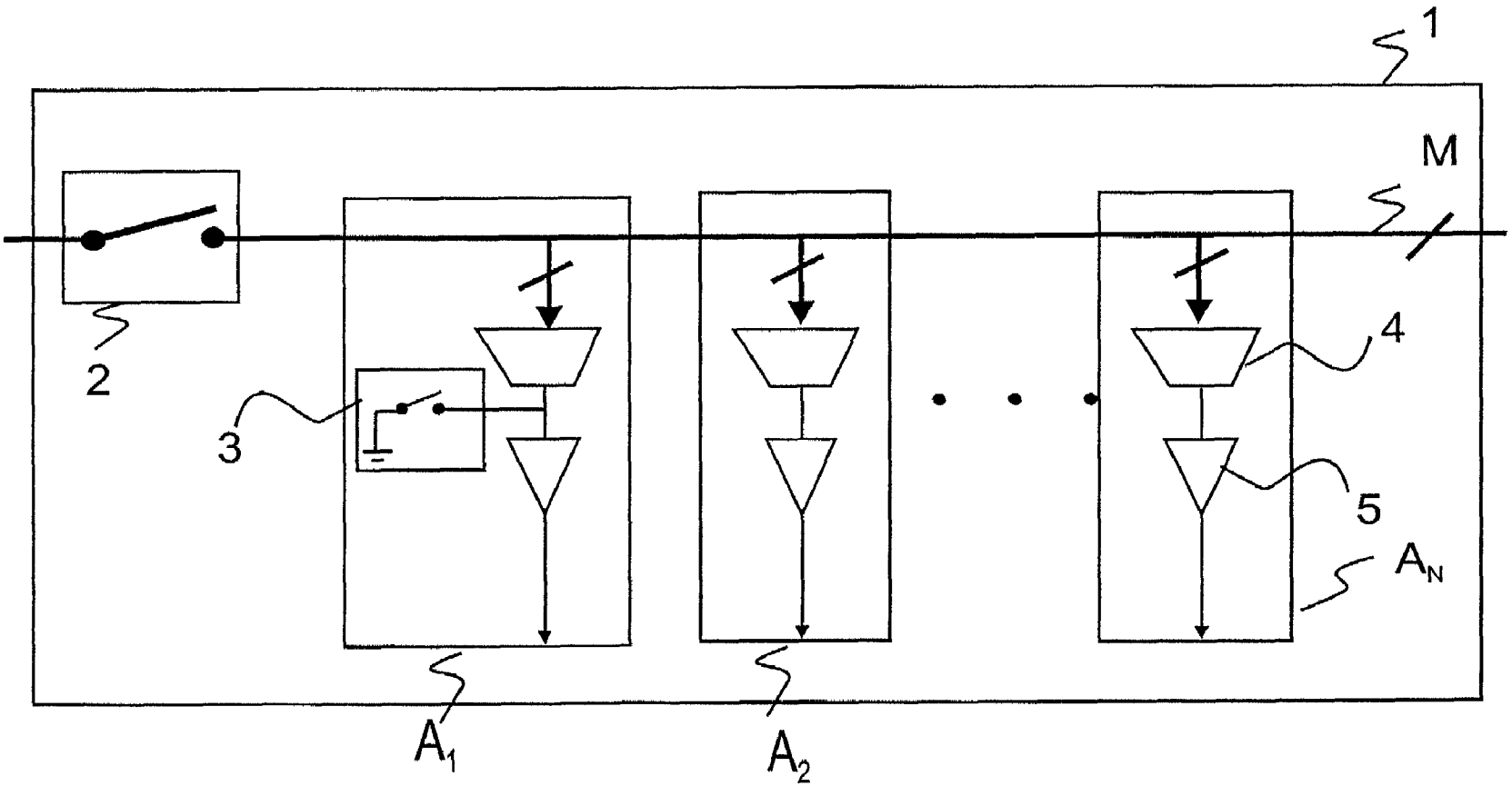
FIG. 1 shows a circuit diagram of a driver circuit in accordance with the invention.

FIG. 1 shows the M leads that may also be understood to be a voltage bus. The M leads usually include 64 individual leads in the case of a 6-bit D/A converter. The M leads are coupled to the first switching device 2. The first switching device 2 enables interruption of the voltage supply to the M leads. N output stages $A_N$ are connected to said M leads, each output stage $A_N$ being connected to at least a part of the M leads. Generally speaking, however, all M leads are connected to each output stage $A_N$, because each terminal of a display device must be supplied with each voltage so as to reproduce image information in the corresponding display area. Respective time multiplex devices 4 are provided in the output stages $A_N$. The multiplex devices 4 are arranged to select one of the voltages that are supplied via the M leads. The multiplex devices 4 are coupled to an amplifier 5 that conducts the selected voltage to the output N. A second switching device 3 is provided in at least one output stage $A_N$. The second switching device 3 is arranged to switch the potential that is applied to the output stage $A_N$ to a test reference potential. The second switching device 3 may also be provided in all output stages $A_N$. It is also feasible for the second switching devices 3 in the output stages $A_N$ to switch to different test reference potentials. The second switching devices may also be provided outside the output stages. The multiplex devices 4 may also be arranged outside the output stages.

Figure 2:
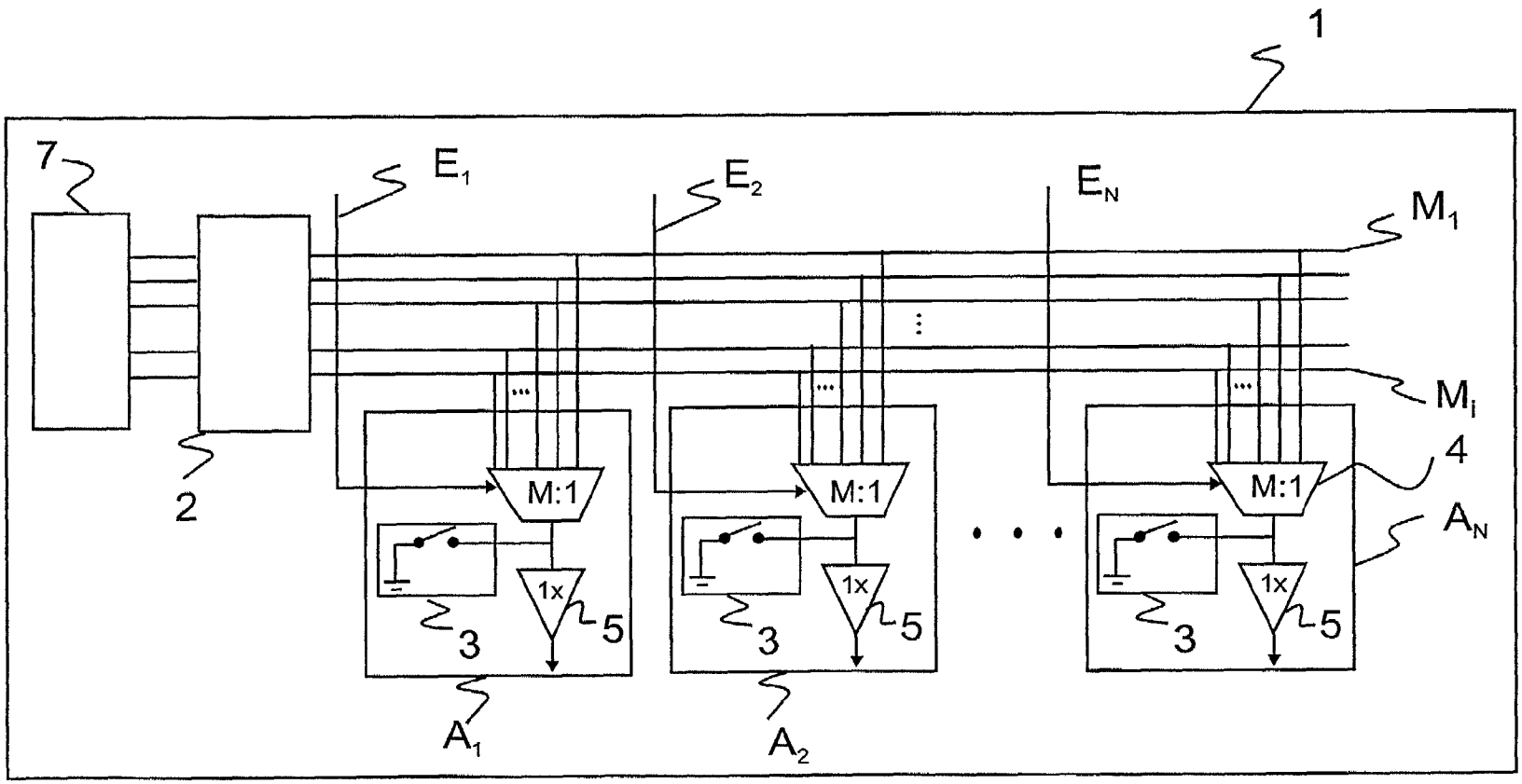
FIG. 2 shows is a detailed representation of a circuit arrangement of a driver circuit in accordance with the invention.

FIG. 2 is a more detailed representation of the described circuit arrangement. The leads $M_1$ to $M_I$ are supplied with one or more voltages by a voltage generator 7. The leads $M_1$ to $M_i$ are conducted to all output stages $A_1$ to $A_N$. In the output stages the leads $M_1$ to $M_i$ are connected to the multiplex devices 4. The multiplex devices 4 apply a corresponding voltage to the output stage $A_N$ in dependence on a digital signal $E_1$ to $E_N$. The first switching device 2 is capable of interrupting the leads $M_1$ to $M_i$ separately from one another. It may also be capable of interconnecting the leads $M_1$ to $M_i$, thus enabling a voltage to be applied to all leads $M_1$ to $M_i$.

Figure 3:
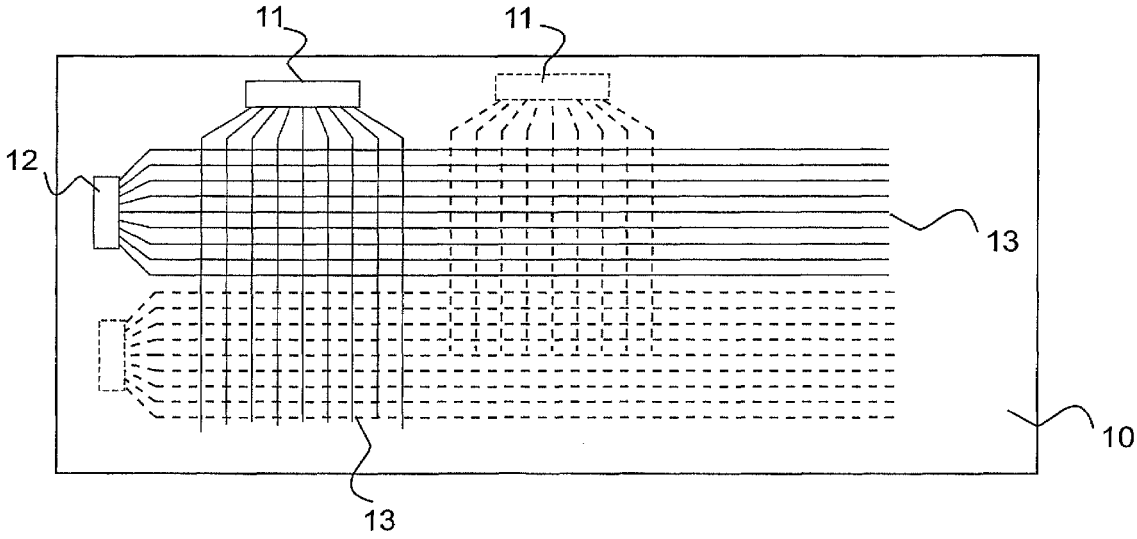
FIG. 3 shows a device for driving a display device.

FIG. 3 shows an active matrix TFT display which typically consists of a display glass 10 with terminals 13 that are fed out. The source drivers 11 and the gate drivers 12 drive the terminals 13. The source drivers 11 typically have several hundred outputs by means of which an analog voltage value is adjusted on the terminals 13 of the display 10.

What is claimed is:

1. A device for driving a display device, which device is provided with M leads that are coupled to at least one multiplex device and are coupled to a voltage generator through a first switching device that enables interruption of a voltage supply to the M leads so that a voltage already present in at least one of the M leads is no longer driven arid is held until any leakage currents or parasitic capacitances give rise to a discharge, and also provided with at least one second switching device that is coupled to the M leads to enable at least one of the M leads that is no longer driven after opening of the first switching device to be switched to a selectable potential.

2. A device as claimed in claim 1, characterized in that the M leads are coupled to $A_N$ output stages that are provided with at least one multiplex device and at least one amplifier unit, and that at least one output stage ($A_N$) is provided with a second switching device for switching the output stage ($A_N$) to a selectable potential.

3. A device as claimed in claim 1, characterized in that second switching devices are provided in all output stages $A_N$.

4. A device as claimed in claim 1, characterized in that the multiplex device that can be controlled by a digital signal is arranged to switch a voltage that is present on the M leads through to the output stage $A_N$.

5. A device as claimed in claim 1, characterized in that the second switching device in the output stage ($A_N$) switches the lead M that is selected by the multiplex device to a test reference potential.

6. A device as claimed in claim 1, characterized in that in a test mode the first switching device connects the M leads to a common potential and separates them from this potential.

7. A device as claimed in claim 1, characterized in that the switching devices can be controlled separately.

8. A display device that includes a driver circuit as claimed in claim 1, in which the output stages $A_N$ are connected to N terminals of a display device.

9. A method of testing a driver circuit, in which the driver circuit is supplied with at least one voltage on M leads, in which the M leads are coupled to a voltage generator through a first switching device so that the voltage supply to the M leads is interrupted by means of the first switching device so that a voltage already present in at least one of the M leads is no longer driven and is held until any leakage currents or parasitic capacitances give rise to a discharge, in which one of the M leads is selected by means of at least one multiplex device that is coupled to the M leads, and in which the supplied voltage on the selected lead is switched to a test reference potential by means of a second switching device.

* * * * *